US006845694B2

(12) United States Patent
Ping

(10) Patent No.: US 6,845,694 B2
(45) Date of Patent: Jan. 25, 2005

(54) FOLDABLE DRIVER TOOL

(75) Inventor: Qiu Jian Ping, Hangzhou (CN)

(73) Assignee: Great Neck Saw Manufacturers, Inc., Mineola, NY (US)

( * ) Notice: Subject to any disclaimer, the term of this patent is extended or adjusted under 35 U.S.C. 154(b) by 47 days.

(21) Appl. No.: 10/315,303

(22) Filed: Dec. 11, 2002

(65) Prior Publication Data

US 2004/0112185 A1 Jun. 17, 2004

(51) Int. Cl.[7] ..... B25B 23/00
(52) U.S. Cl. ..... 81/440; 81/177.4; 81/439
(58) Field of Search ..... 81/440, 439, 437, 81/177.85, 177.4, 438, 490

(56) References Cited

U.S. PATENT DOCUMENTS

| | | | | |
|---|---|---|---|---|
| 516,294 | A | 3/1894 | Britton | |
| 647,528 | A | 4/1900 | Schmidt | |
| 1,128,165 | A | 2/1915 | Mace | |
| 1,230,173 | A | 6/1917 | Kremer | |
| 2,629,413 | A | 2/1953 | Stettler | |
| 2,726,695 | A | 12/1955 | Malm | |
| 3,186,009 | A | 6/1965 | Simmons | |
| 3,892,149 | A | 7/1975 | Rydberg | |
| 4,010,663 | A | 3/1977 | Rydberg | |
| 4,327,790 | A | 5/1982 | Stevens et al. | |
| 4,440,048 | A | 4/1984 | Stevens et al. | |
| 4,463,788 | A | 8/1984 | Corona et al. | |
| 4,476,751 | A | 10/1984 | Mishima | |
| 4,815,346 | A | 3/1989 | Littlehorn | |
| D323,449 | S | 1/1992 | Corona et al. | |
| 5,228,363 | A | 7/1993 | Corona et al. | |
| 5,337,637 | A | 8/1994 | Bih-Lien | |
| D359,671 | S | 6/1995 | Acosta | |
| 5,553,340 | A | 9/1996 | Brown, Jr. | |
| 5,803,584 | A | 9/1998 | Chung | |
| 5,870,786 | A | 2/1999 | Papadopoulos | |
| D415,944 | S | 11/1999 | Chung | |
| 6,332,384 | B1 * | 12/2001 | Cluthe | 81/490 |
| 6,378,407 | B1 * | 4/2002 | Purkapile | 81/490 |
| D459,186 | S | 6/2002 | Chang | |
| 6,508,156 | B1 * | 1/2003 | Wei | 81/490 |
| 6,511,199 | B1 * | 1/2003 | Chung | 362/119 |

* cited by examiner

*Primary Examiner*—Lee D. Wilson
(74) *Attorney, Agent, or Firm*—Joseph J. Previto

(57) ABSTRACT

The foldable driver tool having a handle with an outer wall and a plurality of pockets in the outer wall with each pocket adapted to receive a driver. The driver has a bit portion, a shaft portion and a rear portion. The handle has a head assembly at one end which is made up of a plurality of spaced extensions extending from the outer wall. The spaced extensions form spaces therebetween which are coextensive with the pockets. A front cap having a front wall and a skirt extending rearwardly therefrom is mounted over the head assembly so that the skirt overlies the spaced extensions. A slot is provided in the front wall and an opening is provided in the skirt with the two being coextensive with each other. The front cap is rotatable relative to the head assembly so that the slot and opening are moved into alignment with a space in the head assembly to permit the shaft portion of a driver in a pocket to move out of the pocket in a circular motion and to pass through the space, the opening and the slot to an extended position with the shaft portion of the driver extending through the slot in the front wall. The driver being in its extended position and locked in place to prevent a driver from coming out of the slot.

19 Claims, 6 Drawing Sheets

FOLDABLE DRIVER TOOL

BACKGROUND

The present invention relates to driver tool or similar articles and more particularly to a driver tool or similar article, such as a screwdriver, in which the driver may be folded into the handle.

Foldable drivers have been known for a number of years and comprise the use of a number of drivers with different types of heads or bits, such as straight or phillips screwdriver bits. The drivers are usually stored within the handle and when a particular driver is needed that driver is removed from the handle and placed in an operative position in front of the handle. Many mechanisms have been used for moving the driver out of the handle, placing it in its operative position and replacing it in the handle when no longer needed. With some of these tools, the drivers are manually removed from and replaced in the handle so that there is the possibility that the driver may be dropped or lost in transit. In other tools, various complicated mechanisms are used in order to extend the required driver out of the handle and replace it back into the handle.

OBJECTS

The present invention overcomes these difficulties and provides an improved foldable driver tool in which a number of drivers may be easily stored in the handle and the desired one may be easily placed in its operative position.

Another object of the present invention is the provision of an improved foldable driver tool in which each driver is moved in and out of a handle without the driver being physically disengaged from the handle Another object of the present invention is the provision of an improved foldable driver tool which is simple and inexpensive to operate and maintain.

Other and further objects of the invention will be obvious upon an understanding of the illustrative embodiment about to be described, or will be indicated in the appended claims and various advantages not referred to herein will occur to one skilled in the art upon employment of the invention in practice.

DRAWINGS

A preferred embodiment of the invention has been chosen for purposes of illustration and description and is shown in the accompanying drawings forming a part of the specification, wherein.

DESCRIPTION

Figure 1:
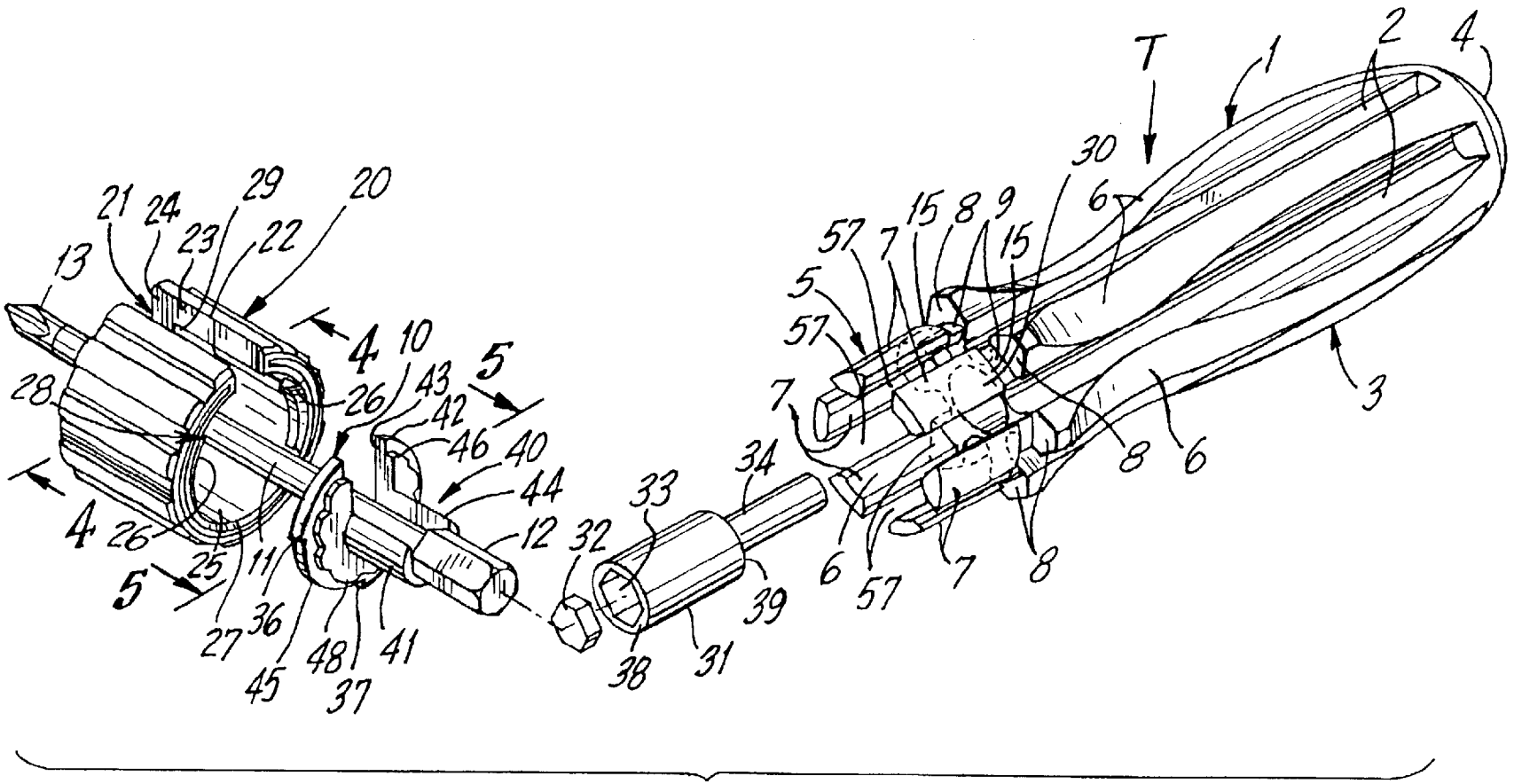
FIG. 1 is a exploded perspective view of the driver tool of the present invention.
Figure 2:
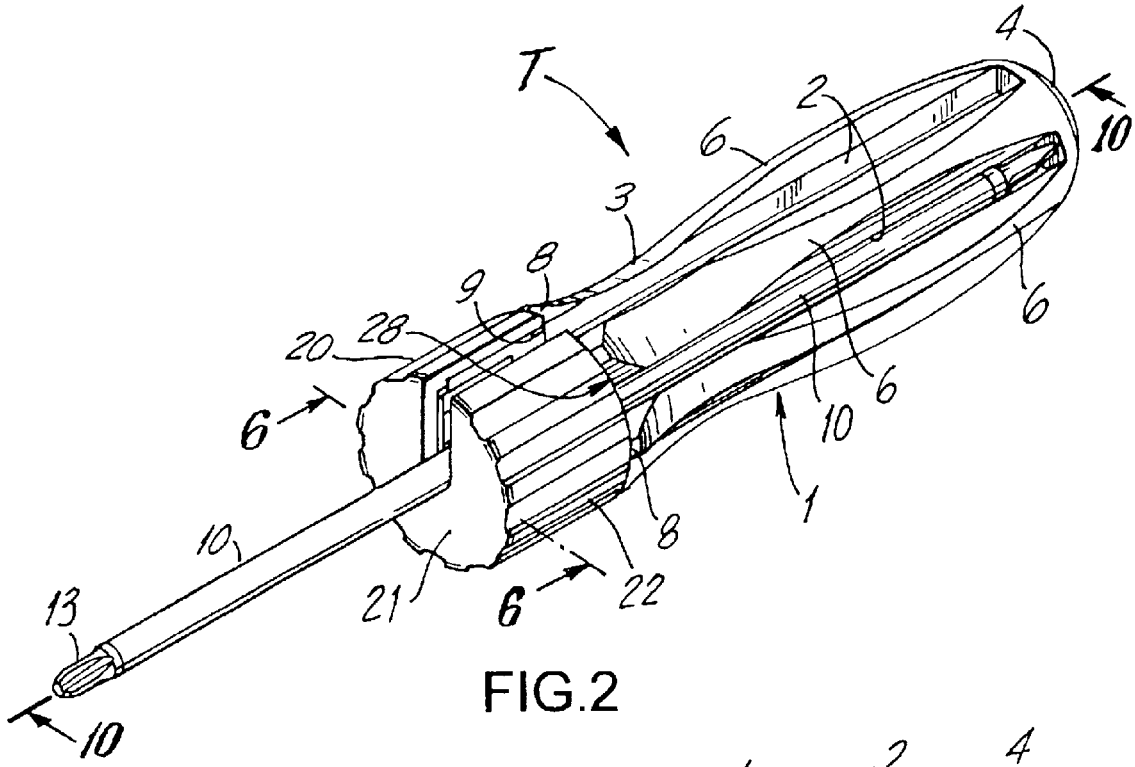
FIG. 2 is a perspective view of the driver tool showing a driver in its operative extended position.
Figure 3:
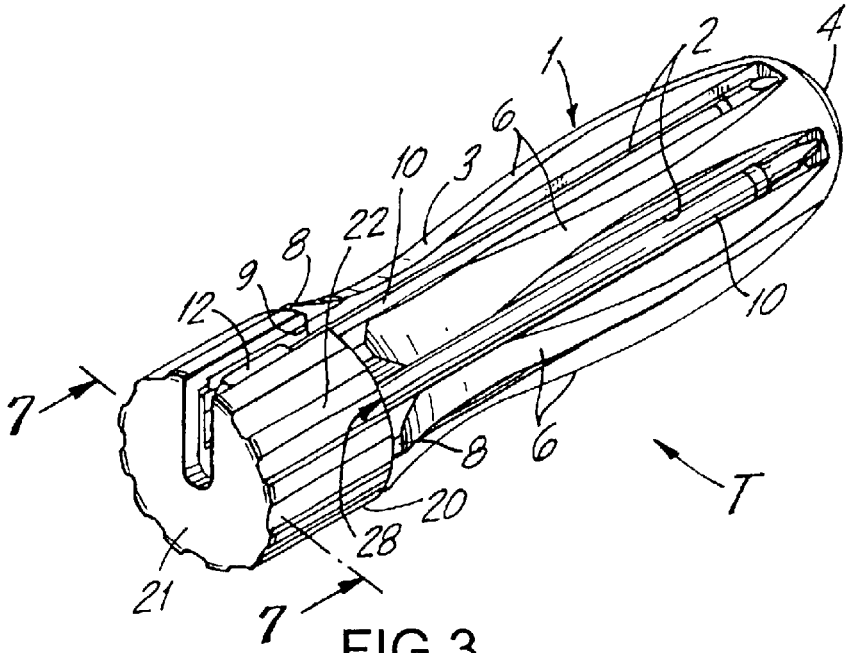
FIG. 3 is a perspective view of the driver tool showing the driver in its retracted position.
Figure 4:
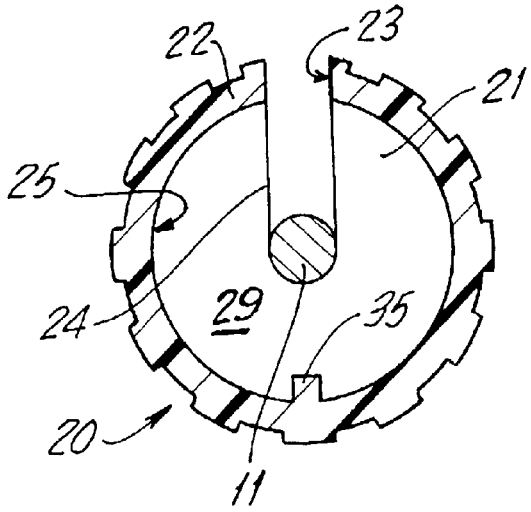
FIG. 4 is a sectional view taken along line 4—4 of FIG. 1 showing the interior of the front cap of the tool.
Figure 5:
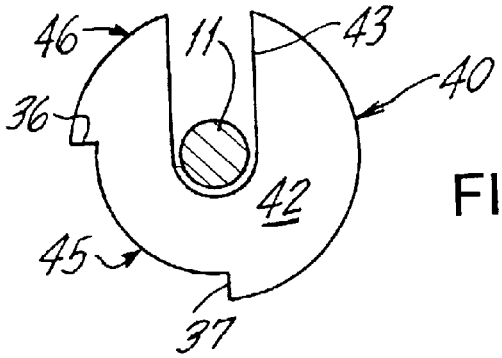
FIG. 5 is a sectional view taken along line 5—5 of FIG. 1 showing the front face of the control piece of the tool.

Referring to the drawings, the foldable driver tool T of the present invention comprises a handle 1 having an outer circumferential wall 3, a rear cap 4, a head assembly 5 and a plurality of spaced elongated pockets 2 formed in its outer wall 3 and separated by ribs 6 which terminate in shoulders 8. The pockets 2 are adapted to receive and hold a different driver 10, e.g. drivers with a phillips or straight bits. The head assembly 5 comprises a plurality of spaced extensions 7 which are extensions of the ribs 6 on the outer surface of the handle 3 and comprise front end 16 and rear edge 15 which form grooves 9 with shoulders 8. The extensions 7 are separated by spaces 57. Each groove 9 is formed between rear edge 15 and shoulder 7 is narrower than extensions 7 and ribs 6. This will give the extensions 7 resiliency and permit them to flex automatically away from the longitudinal axis of the handle 1.

Each driver 10 has a shaft portion 11, a rear portion 12 and a front bit portion 13. The rear portion 12 is shown as having a hexagonally shaped cross-section of greater thickness than the shaft 11. If desired, the rear portion 12 may be of a different cross-section so long as it is thicker than the shaft 11 or has a portion that is thicker than the shaft 11. The spaces 57 between extensions 7 are large enough to allow the shaft 11 to move therethrough but is too small to allow the rear portion 12 to move therethrough.

A front cap 20 is rotatably mounted over the head assembly 5 of the handle 1 (i.e. over the extensions 7) and is provided with a front wall 21 and a skirt 22 extending rearwardly therefrom. The lower edge 28 of the skirt 22 has a pair of spaced curved ledges 26 extending inwardly from its inner surface 25 to form a space 27 therebetween. The lower edge 28 sits on the shoulders 8 of ribs 6 and the ledges 26 snaps into the grooves 9 between shoulders 8 of ribs 6 and edges 15 of extensions 7 to hold the front cap 20 in place. The front wall 21 of the front cap 20 has a slot 24 extending from its center to the skirt 22 and the skirt 22 has an opening 23 extending throughout its length and communicating with slot 24 in front wall 21. Both the slot 24 in front wall 21 and opening 23 in the skirt 22 are preferably approximately of the same width and both are large enough to permit the shaft of the driver 10 to move therebetween but are too small to allow the rear portion 12 of the driver 10 to move therebetween. Opposite the slot 24 on its inner face 29, the front wall 21 is provided with a stop finger 35 extending upwardly from inner face 29 of the front wall 21 and inwardly from the inner surface 25 of the skirt 22. The stop finger 35 is preferably integral with the front cap 20.

Mounted in an opening 30 at the center of the handle 1 is a cup 31 having a socket 33 at its front end 38 and a leg 34 extending rearwardly from its rear end 39. The cup 31 is held fast in opening 30 so that it will rotate with the handle 1. The cup 31 is adapted to receive a magnet 32 which is preferably mounted within (preferably, at the bottom) of socket 33 in the cup 31. The socket 33 is preferably hexagonally shaped in a manner similar to the shape of the rear portion 12 of a driver 10 so as to be able to receive the said rear portion 12 therewithin and to cause driver 10 to rotate when the handle 1 is rotated.

A control piece 40 is mounted within the front cap 20. The control piece 40 has a front plate 42 and a rearwardly extending hollow stem 41 through which shaft 11 of a driver 10 is adapted to extend when the driver 10 is in its extended operative position. The stem 41 has an opening 44 therein and the front plate 42 has a slot 43 which are coextensive with each other and are preferably of the same width. The slot 43 and opening 44 are both large enough to permit shaft 11 of a driver 10 to move therebetween but are too small to permit the rear portion 12 of the driver 10 to move therethrough. The rim 46 of the front plate 42 has an arcuate slot 45 therein terminating in opposed stop shoulders 36 and 37. The control piece 40 is provided with a toothed shelf 47 immediately beneath the front plate 42 (and shown as being preferably integral therewith) with the slot 43 in the front plate 42 and the opening 44 in the stem 41 extending into the shelf 47. The outer edge of the shelf 47 is provided with a plurality of teeth 48 which are adapted to cooperate and mesh with the spaced resilient extensions 7 in the handle 1, as will be more fully referred to hereinafter.

Figure 14:
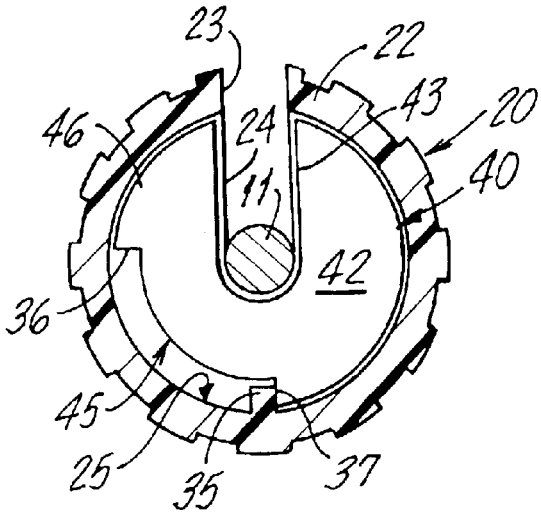
FIG. 14 is a schematic sectional view taken along line 14—14 of FIG. 10 showing the position of the parts where the driver is first extended to it operative position.
Figure 15:
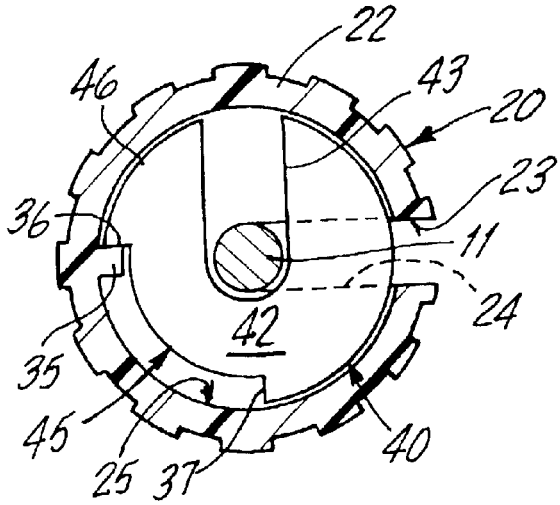
FIG. 15 is a schematic sectional view similar to FIG. 14 showing the position of the parts when the driver is locked in place in its operative position.
Figure 8:
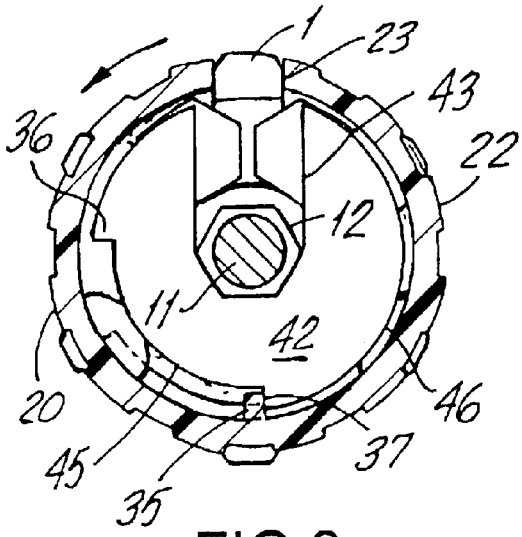
FIG. 8 is a sectional view similar to FIG. 6 showing the position of parts when the tool is placed in one position.
Figure 9:
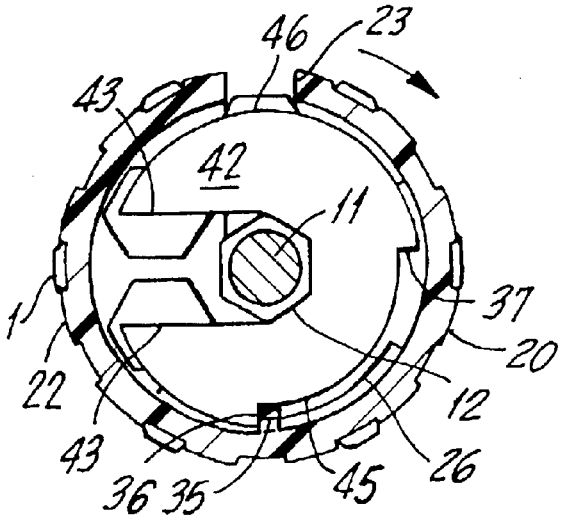
FIG. 9 is a sectional view similar to FIG. 6 showing the position of the parts when the tool is placed in a different position.

The front cap 20 is rotatable relative to the control piece 40 and to the handle 1 so that rotation of the front cap 20 in one direction will move its opening 23 and slot 24 into alignment with the opening 44 and slot 43 in the control piece 40 (FIGS. 8 and 14) and rotation of the front cap 20 in the opposite direction moves said opening 23 and slot 24 to a position out of alignment of the slot 43 and opening 44 in the control piece 40 (FIGS. 9 and 15). When the front cap 20 is moved to a position where its slot 24 and opening 23 is in alignment with the slot 43 and opening 44 in the control piece 40, the shaft 11 of a driver 10 may move in and out of the slots 43–24 and openings 44–23 in the control piece 40 and the front cap 20, respectively. When the front cap 20 is moved to a position where its slot 24 and opening 23 are out of alignment with the slot 43 and the opening 44 in the control piece 40, the shaft 11 of the driver 10 cannot be moved out of the slots 43–24 and openings 44–23 because the front wall 21 of the front cap 20 lies over the slot 43 in the control piece 40 (FIG. 15) so that the shaft 11 is held by front wall 21 in front front cap 20 and front plate 42 in control piece 40 and locked in place in the slot 24 in front cap 20 and in the slot 43 control piece 40. The rotation of the front cap 20 relative to control piece 40 is limited by the stop finger 35 on the front cap 20 which strikes stop shoulders 36 and 37 at each end of the arcuate slot 45 in front plate 42 of control piece 40. When the front cap 20 is being rotated in either direction, its stop finger 35 rides in arcuate slot 45 until it strikes either stop shoulder 36 or 37, at which point, continued rotation of the front cap 20 will move the control piece 40 in the same direction. The teeth 48 in control piece 40 will move and snap past resilient extension 7 which will flex outwardly to allow the teeth 48 to move past.

Figure 6:
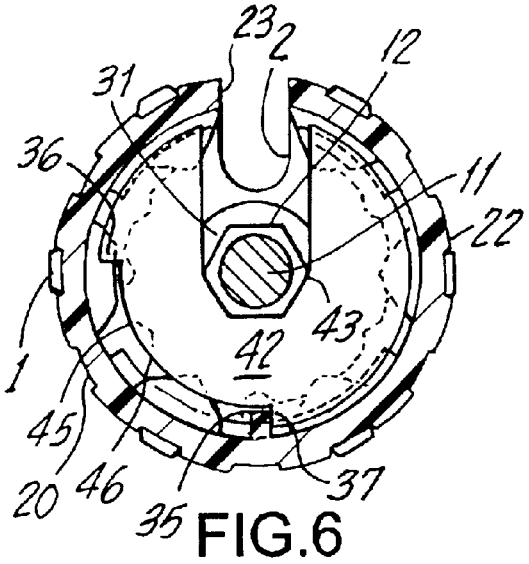
FIG. 6 is a sectional view taken along line 6—6 of FIG. 2.
Figure 7:
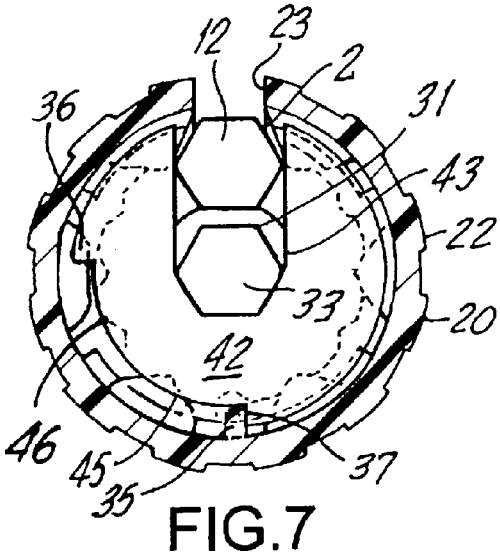
FIG. 7 is a sectional view taken along line 7—7 of FIG. 3.
Figure 10:
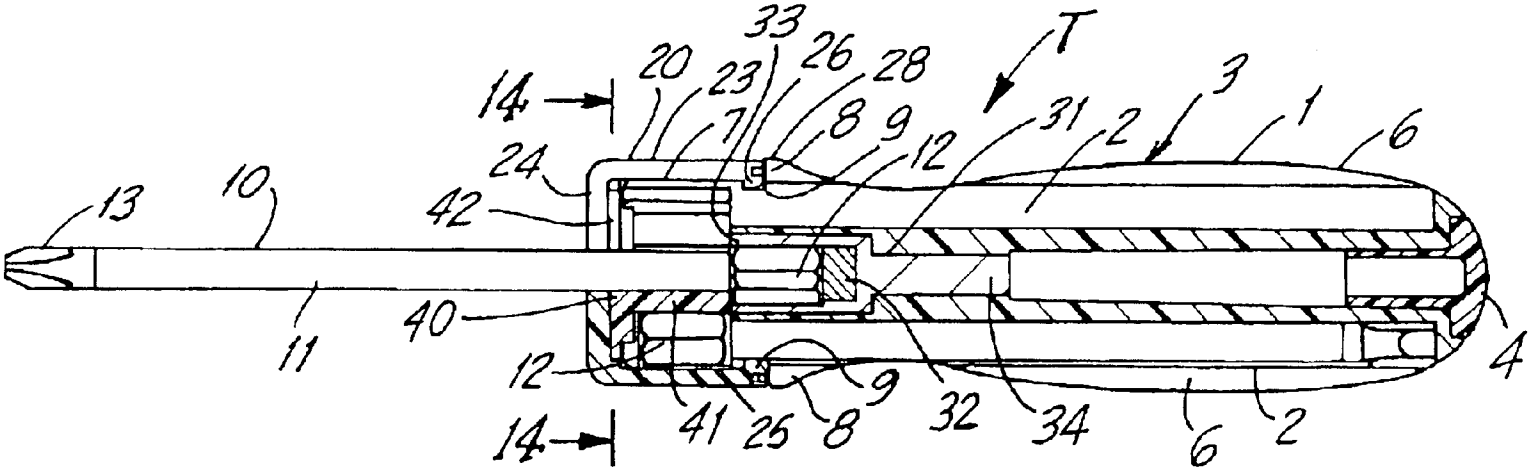
FIG. 10 is a sectional view taken along line 10—10 of FIG. 2 showing the position of the parts when the driver is in its extended operative position.
Figure 11:
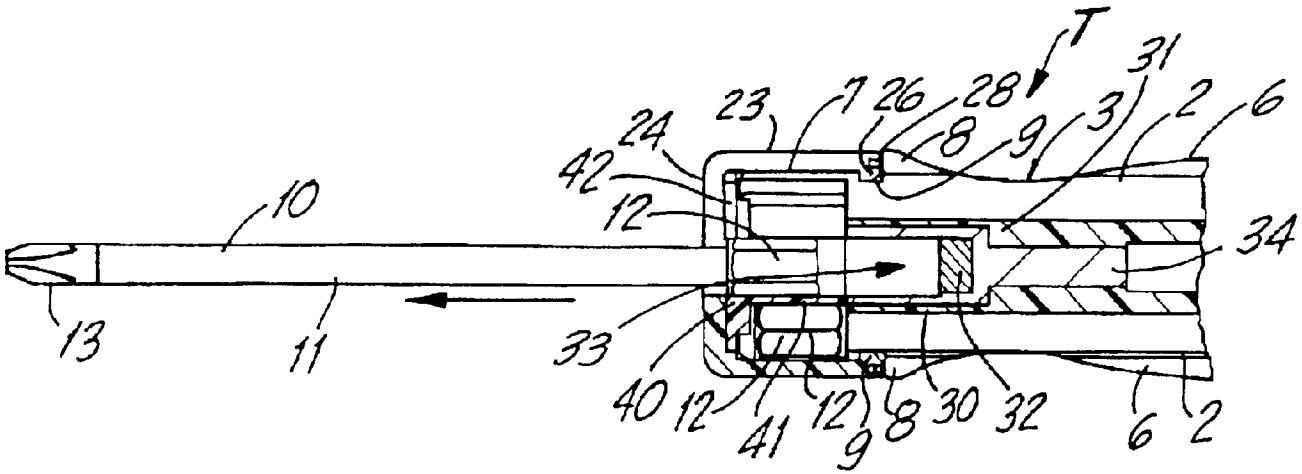
FIG. 11 is a sectional view similar to FIG. 10 showing the position of the parts when the driver is being removed from or replaced in its operative position.
Figure 12:
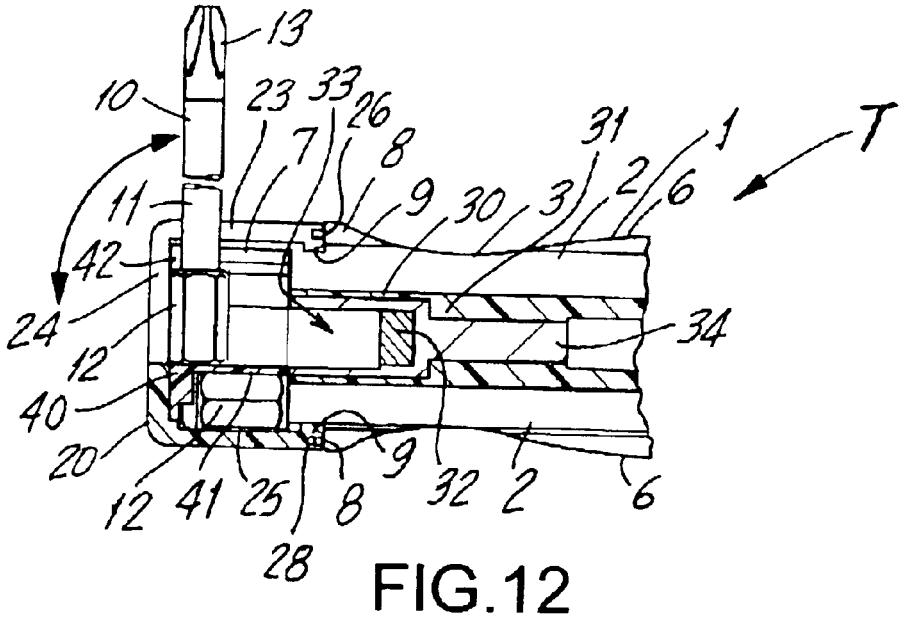
FIG. 12 is a sectional view similar to FIG. 10 showing the position of the parts when the driver is in the process of being folded relative the handle in either direction.
Figure 13:
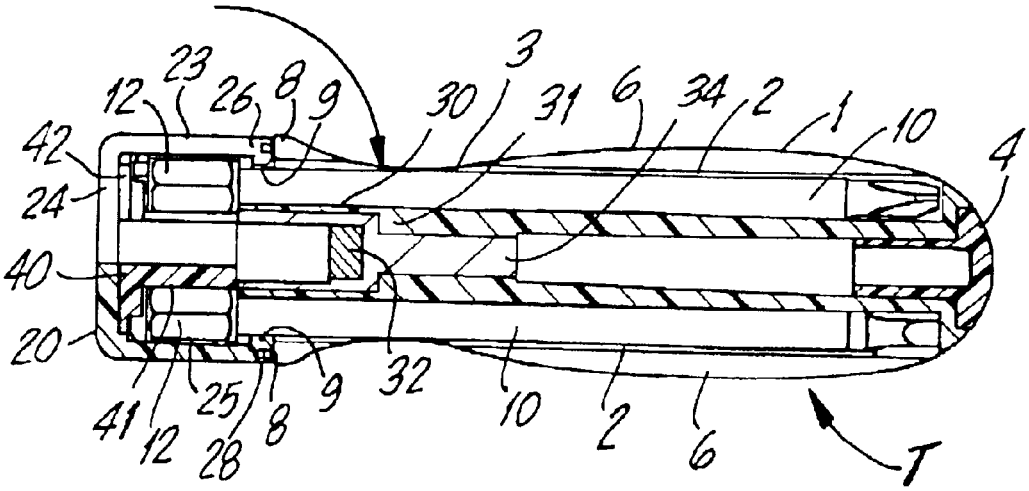
FIG. 13 is a sectional view similar to FIG. 10 showing the position of the parts when the driver is fully folded within the handle.

With this structure, when it is desired to place a driver 10 in its operative position, the front cap 20 is rotated in one direction until the stop finger 35 strikes the stop shoulder 37 and slots 43–24 and openings 44–23 in the control piece 40 and front cap 20, respectively, are moved into alignment with each other (FIGS. 8 and 14). This rotation is continued with the control piece 40 and front cap 20 being moved together in the same direction until the aligned slots 43–44 and openings 24–23 are over a particular driver 10 in a particular pocket 2 in the handle 1 (FIGS. 7 and 13). The control piece 40 is moved together with the front cap 20 because the stop finger 35 continues to bear against and be in contact with shoulder 37 thereby pushing the control piece 40 along with the front cap 20. When in this position, a driver 10 is moved out of the pocket 21 and its shaft 11 is moved in a counter-clockwise movement through the slots 43–24 and openings 44–23 in control piece 40 and front cap 20, respectively (FIG. 12). The rear portion 12 pivots within the head assembly 5 and within the confines of the extensions 7 but it cannot be moved out of the tool because it is larger than slots 43–24, and openings 44–23 and spaces 57 between extensions 7. The driver 10 is then placed in an extended position (FIG. 11) and its rear portion 12 is moved into the cup opening 33 where it strikes the magnet 32 to hold the driver 10 in place (FIGS. 6 and 10). The front cap 20 is then rotated in the opposite direction (FIGS. 9 and 15) so that the slot and opening 23 and 24 in the front cap 20 are out of alignment with the slot and opening 44–43 in the control piece 40. In this position, the driver is held and locked in place because the front wall 21 of the front cap 20 is moved over and overlies the slot 43 in front plate 42 of control piece 40, so that shaft 11 is held by front wall 21 and front plate 42 and locked in place in slots 24 and 43 in front cap 20 and control piece 40, respectfully. The driver 10 may now be used by rotating the handle 3 which will rotate the driver 10 through the intermediation of the hexagonal rear front 12 and the hexagon sought 33 in cap 30.

When it is desired to place the driver 10 back into its pocket 2, the reverse operation is performed. The front cap 20 is rotated in the opposite direction to place its opening and slot 24–23 back into alignment with the opening and slot 43–44 in the control piece 40. The control piece 40 is rotated with the front cap 20 in said opposite direction by means of stop finger 35 striking stop shoulder 37. The opposite rotation continues until the empty pocket 2 is reached (FIGS. 6, 10, and 14). The driver 10 is pulled away from the magnet 32 (FIG. 11) and is rotated in a circular counterclockwise motion through the spaces 57 in head assembly 5, openings 23–44 and slots 24–43 in the front cap 20 and the control piece 40, respectively, (FIG. 12) and placed back into that empty pocket 2 (FIGS. 7 and 13). After this is done, the front cap 20 and the control piece 40 may be moved to another pocket so that another driver 10 can be placed in its operative position.

It will thus be seen that the present invention provides an improved foldable driver tool in which a number of drivers may be easily stored in the handle, in which the desired one may be easily placed in its operative position, in which each driver is moved in and out of a handle without the driver being physically disengaged from the handle and which is simple and inexpensive to operate and maintain.

As many and varied modifications of this subject matter of this invention will become apparent to those skilled in the art from the detailed description given hereinabove, it will be understood that the present invention is limited only as provided in the claims appended hereto.

The embodiments of the invention in which an exclusive property or privilege is claimed are defined as follows:

1. A foldable driver tool comprising a handle having a central axis and an outer wall, a plurality of pockets in said outer wall, said pockets being parallel to said central axis, each of said pockets adapted to receive a driver comprising a bit portion, a shaft portion and a rear portion, said handle having a head assembly at one end, said head assembly comprising a plurality of spaced extensions extending from said outer wall, said spaced extensions forming spaces therebetween coextensive with said pockets, a front cap having front wall and a skirt extending rearwardly therefrom, said front cap mounted over said head assembly whereby said skirt overlies said spaced extensions, a slot in said front wall and an opening in said skirt, said slot and opening being coextensive with each other and communicating with each other, said front cap being rotatable relative to said head assembly whereby said slot and opening are moved into alignment with a space in said head assembly thereby permitting the shaft portion of a driver in a pocket to move out of the pocket in a circular motion at a right angle to said pocket and to said central axis and to pass through said space between said spaced extensions as well as, said opening in said front wall and said slot in said skirt to a extended position with the shaft portion of the driver extending through the slot in said front wall, means for holding a driver in said extended position and for locking and preventing a driver in said extended position from moving out of said slot.

2. A foldable driver as set forth in claim 1, wherein said locking means comprises a control piece mounted in said front cap and wherein said front cap is rotatable relative to the control piece.

3. A foldable driver as set forth in claim 2, wherein said control piece comprises a front plate and a hollow stem extending rearwardly therefrom and wherein the shaft portion of a driver is adapted to extend through the hollow stem when the driver is in said extended position.

4. A foldable driver as set forth in claim 3, wherein said front plate has a slot therein and wherein said stem has an opening therein coextensive with said slot whereby the driver in said circular motion moves through said opening and slot in said control piece.

5. A foldable driver comprising a handle having an outer wall, a plurality of pockets in said outer wall, each of said pockets adapted to receive a driver comprising a bit portion, a shaft portion and a rear portion, said handle having a head assembly at one end, said head assembly comprising a plurality of spaced extensions extending from said outer wall, said spaced extensions forming spaces therebetween coextensive with said pockets, a front cap having a front wall and a skirt extending rearwardly therefrom, said front cap mounted over said head assembly whereby said skirt overlies said spaced extensions, a slot in said front wall and an opening in said skirt, said slot and opening being coextensive with each other, said front cap being rotatable relative to said head assembly whereby said slot and opening are moved into alignment with a space in said head assembly thereby permitting the shaft portion of a driver in a pocket to move out of the pocket in a circular motion and to pass through said space, said opening and said slot to a extended position with the shaft portion of the driver extending through the slot in said front wall, means for holding a driver in said extended position and for locking and preventing a driver in said extended position from moving out of said slot, said locking means comprises a control piece mounted in said front cap and wherein said front cap is rotatable relative to the control piece, said control piece comprises a front plate and a hollow stem extending rearwardly therefrom and wherein the shaft portion of a driver is adapted to extend through the hollow stem when the driver is in said extended position, said front plate has a slot therein and wherein said stem has an opening therein coextensive with said slot whereby the driver in said circular motion moves through said opening and slot in said control piece, said control piece has a notch in it front plate to form spaced first and second stop shoulders.

6. A foldable driver as set forth in claim 5, wherein said front cap is provided with a stop finger and wherein rotation of the front cap in either direction relative to said control piece causes said stop finger to strike said stop shoulders.

7. A foldable driver as set forth in claim 6, wherein rotation of the front cap in one direction moves the slot and opening in the front cap into alignment with the slot and opening of the control piece and wherein continued rotation of the front cap relative to the control piece in said one direction causes said stop finger to strike said first stop shoulder to move the control piece together with said front cap in that same direction with the openings and slots in the front cap and control piece remaining in alignment with each other.

8. A foldable driver as set forth in claim 7, wherein rotation of the front cap in the opposite direction moves the slot and opening in the front cap out of alignment with the slot and opening in the control piece thereby moving the front wall of the front cap to an overlying position over the slot in the front plate of the control piece thereby locking and holding the extended driver in place and preventing it from moving out of the slot in the front wall of the front cap.

9. A foldable driver as set forth in claim 8, wherein continued rotation of the front cap in said opposite direction will cause the stop finger to strike said second stop shoulder and move said control piece in said opposite direction with said openings and slots in said front cap and control piece remaining out of alignment with each other and with said front wall of the front cap remaining in overlying position over the slot in the front plate.

10. A foldable driver as set forth in claim 9, wherein said holding means comprise a cup mounted in said handle and having a socket to receive the rear portion of a driver.

11. A foldable driver as set forth in claim 10, wherein a magnet is provided in said handle.

12. A foldable driver as set forth in claim 11, wherein magnet is mounted within said socket in said cup.

13. A foldable driver as set forth in claim 12, wherein the rear portion of a driver is wider than said shaft portion and wherein said rear portion and said socket have cooperating means whereby rotation of the handle causes rotation of a driver mounted in said cup.

14. A foldable driver as set forth in claim 13, wherein the width of the slot and openings in the front cap and the control piece are wide enough to permit the shaft portion of a driver to move therethrough but are narrow enough to prevent the rear portion of a driver to be moved therethrough.

15. A foldable driver as set forth in claim 14, wherein the spaces between said spaced extensions are substantially the same as the width of the slot and openings in the front cap and the control piece whereby the shaft portion of the driver is movable therethrough but the rear portion of the driver is not.

16. A foldable driver as set forth in claim 15, wherein ribs are provided between said pockets in said handle and wherein each of said ribs terminates in a shoulder.

17. A foldable driver as set forth in claim 16, wherein said extensions have a front end and a rear edge, the rear edge of each extension is spaced from said shoulder to form a groove and wherein ledges are provided in the skirt on the front cap adapted to be inserted in said groove.

18. A foldable driver as set forth in claim 17, wherein the front plate of the control piece has a toothed portion and wherein said toothed portion meshes with the extensions in said head assembly.

19. A foldable driver as set forth in claim 18, wherein the rear portion of a driver lies within the head assembly of the handle when its shaft portion lies in a pocket in the handle.

* * * * *